US007300120B2

(12) United States Patent
Shin

(10) Patent No.: US 7,300,120 B2
(45) Date of Patent: Nov. 27, 2007

(54) MOUNTING STRUCTURE OF DOOR BASKET FOR REFRIGERATOR

(75) Inventor: Tae-Su Shin, Daejeon (KR)

(73) Assignee: LG Electronics Inc., Seoul (KR)

( * ) Notice: Subject to any disclaimer, the term of this patent is extended or adjusted under 35 U.S.C. 154(b) by 257 days.

(21) Appl. No.: 10/946,291

(22) Filed: Sep. 22, 2004

(65) Prior Publication Data

US 2005/0067930 A1 Mar. 31, 2005

(30) Foreign Application Priority Data

Sep. 30, 2003 (KR) ..... 10-2003-0068066

(51) Int. Cl.
*A47B 96/06* (2006.01)

(52) U.S. Cl. ..... 312/404; 108/108

(58) Field of Classification Search ..... 108/106, 108/107, 108; 312/404, 408, 351, 321.5, 312/405.1; 248/220.22, 220.21, 220.41, 248/220.43, 222.51, 22.53; 52/36.4, 36.5, 52/36.6

See application file for complete search history.

(56) References Cited

U.S. PATENT DOCUMENTS 2,321,865 A * 6/1943 Schweller ..... 312/408
3,178,061 A * 4/1965 Giacalone et al. ..... 222/129
3,331,646 A * 7/1967 Peters ..... 312/270.3
4,325,178 A * 4/1982 Pruehs ..... 29/458
4,375,741 A * 3/1983 Paliwoda ..... 52/127.1
4,615,448 A * 10/1986 Johnstonbaugh ..... 211/94.01
4,735,468 A * 4/1988 Taylor et al. ..... 312/408
4,779,939 A * 10/1988 Stich ..... 312/405
5,018,323 A * 5/1991 Clausen ..... 52/36.4
5,138,803 A * 8/1992 Grossen ..... 52/36.4
5,185,971 A * 2/1993 Johnson, Jr. ..... 52/36.6
5,791,093 A * 8/1998 Diamond ..... 52/36.5
5,927,840 A * 7/1999 Bzowski ..... 312/321.5

* cited by examiner

*Primary Examiner*—Janet M. Wilkens
(74) *Attorney, Agent, or Firm*—Ked & Associates, LLP

(57) ABSTRACT

A mounting structure of a door basket for a refrigerator is provided. The mounting structure includes a door liner, which defines a rear surface of a door and includes at least one slot that is formed from side to side by recessing a portion of an outer surface of the door liner, a slot cover configured to protect at least one outward projection, which is formed on a rear surface of the door liner by forming the slot, from a pressure of foam for forming an insulating layer, and a door basket, in which a storage space is formed, and which is provided with at least one mounting projection which is inserted into the slot and then slides from side to side. Since the slot cover prevents the slot from being deformed during a foaming process for forming the isolating layer within the door, it is possible to reduce the defective rate of the product and to minimize a thickness of the door liner, which makes it possible to reduce production costs.

18 Claims, 5 Drawing Sheets

MOUNTING STRUCTURE OF DOOR BASKET FOR REFRIGERATOR

BACKGROUND OF THE INVENTION

1. Field of Invention

The present invention relates to a refrigerator, and more particularly, to a mounting structure of a door basket which can be mounted to a rear surface of a door of a refrigerator to move from side to side along the rear surface.

2. Description of the Prior Art

FIGS. 1*a* and 1*b* show a mounting structure of a door basket according to a prior art. Referring to the figures, a door 10, which selectively opens and closes a storage space (not shown) of a refrigerator, comprises an external appearance plate 11 defining external appearances of front, side, upper, and lower surfaces of the door and a door liner 13 defining an external appearance of a rear surface of the door. An insulating layer 14 is formed between the external appearance plate 11 and the door liner 13. The insulating layer 14 is formed from foamed polyurethane.

A pair of forward protruding projections 15 are formed vertically at both side ends of an outer surface of the door liner 13 corresponding to the rear surface of the door 10. In addition, a plurality of slots 17 are formed from side to side between the projections 15. Each of the slots 17 is formed by recessing a portion of the door liner 13. Further, a pair of the slots 17 are provided at upper and lower portions on the outer surface of the door liner 13, respectively. Since an inlet 17*a* of each slot 17 is formed to be relatively narrower than an interior 17*b* thereof, mounting projections 23, which will be described bellow, are inserted into the slots 17, and then, are not detached to the outside.

A door basket 20, which is mounted onto the outer surface of the door liner 13 and in which a storage space 21 is formed, is formed from side to side. A length from side to side of the door basket 20 is formed to be shorter than an interval between the projections 15. A rear surface of the door basket 20 is provided with a plurality of the mounting projections 23 and 23' which cause the door basket 20 to be mounted to the door liner 13.

A pair of the mounting projections 23 and 23' protrude rearward from and are provided at upper and lower portions on the rear surface of the door basket 20 in two rows. Preferably, two pairs of the mounting projections 23 and 23' are provided at the upper and lower portions of the rear surface of the door basket 20, so that there are provided at least four mounting projections. The upper mounting projection 23 is press fitted into the inlet 17*a* of the upper slot 17, while the lower mounting projections 23' is brought into contact with a ceiling in the lower slot 17 to serve to support load of the door basket 20. The door basket 20 including the mounting projection 23 or the mounting projection 23 may be formed of material having predetermined elasticity.

However, the mounting structure of the door basket for the refrigerator according to the above prior art has the following problems.

That is, in a manufacturing process of the door 10, a space between the external appearance plate 11 and the door liner 13 is filled with foam liquid. Here, due to a pressure of the foam liquid, a shape of the slot 17 is deformed, as shown in FIG. 2.

If the slot 17 is deformed as above, it is not easy for the mounting projection 23 to be inserted into the slot 17. Furthermore, with the mounting projection 23 being inserted into the slot 17, the door basket 20 cannot slide from side to side, causing the articles to be defective.

In order to solve the above problems, the thickness of the door liner 13 can be increased above the value capable of resisting the pressure generated from the foam liquid. However, if the thickness of the door liner 13 increases, the production costs thereof also increase. Furthermore, since there is a limit in increasing the thickness of the door liner 13, the increase of the thickness of the door liner is not effective in preventing the slot 17 from being deformed.

SUMMARY OF THE INVENTION

Accordingly, the present invention is conceived to solve the aforementioned problems in the prior art. An object of the present invention is to provide a mounting structure of a door basket for a refrigerator wherein slots along which a door basket can move are precisely formed.

Another object of the present invention is to provide a mounting structure of a door basket for a refrigerator wherein the production costs thereof can be reduced.

According to an aspect of the present invention for achieving the objects, there is provided a mounting structure of a door basket for a refrigerator, comprising a door liner for defining a rear surface of a door, the door liner including at least one slot, the slot being formed from side to side by recessing a portion of an outer surface of the door liner; a slot cover for protecting at least one outward projection of the slot from a foam pressure applied when forming an insulating layer, the outward projection of the slot being formed on a rear surface of the door liner by forming the slot; and a door basket formed with a storage space therein and provided with at least one mounting projection inserted into and slid from side to side along the slot.

The slot cover comprises: a cover body installed in a position spaced apart by a predetermined interval from an inner surface of the door liner, the cover body being adjacent to a distal portion of the slot corresponding projection; and a pair of upper and lower cover portions protruding from a surface of the cover body toward the slot corresponding projection, the upper and lower cover portions being shaped to correspond to upper and lower surfaces of the slot corresponding projection, respectively.

Preferably, an inlet of the slot is formed to be relatively narrower than an interior thereof, and a distal end of any one of the upper and lower cover portions further comprises an inclined portion, the inclined portion extending to incline at a predetermined angle toward a proximal portion of the slot corresponding projection corresponding to the inlet of the slot and being in close contact with the slot corresponding projection.

The slot corresponding projection is inserted between the upper and lower cover portions, so that the slot cover is temporarily fixed to the inner surface of the door liner.

The slot cover are further provided with a plurality of foamed holes, through which foam liquid injected in order to insulate an interior of the door flows into a space between the door liner and the slot cover.

The slot cover further comprises a reinforcement rib opposite to the surface formed with the upper and lower cover portions.

According to the mounting structure of the door basket for the refrigerator according to the present invention, there are advantages in that defective rates of the article are reduced and the production costs thereof are also reduced.

BRIEF DESCRIPTION OF THE DRAWINGS

The above and other objects, features and advantages of the present invention will become apparent from the following description of a preferred embodiment given in conjunction with the accompanying drawings, in which.

DETAILED DESCRIPTION OF THE PREFERRED EMBODIMENT

Hereinafter, a preferred embodiment of a mounting structure of a door basket for a refrigerator according to the present invention will be described in detail with reference to the accompanying drawings.

Figure 1A:
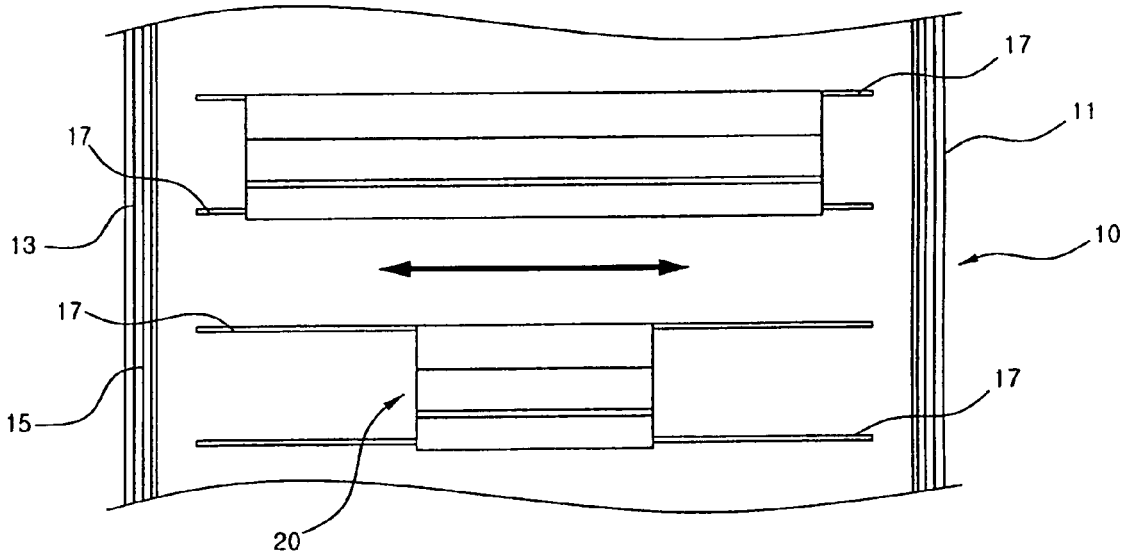
FIG. 1a Prior Art
FIG. 1*a* is a front view showing a mounting structure of a door basket for a refrigerator according to a prior art.
Figure 1B:
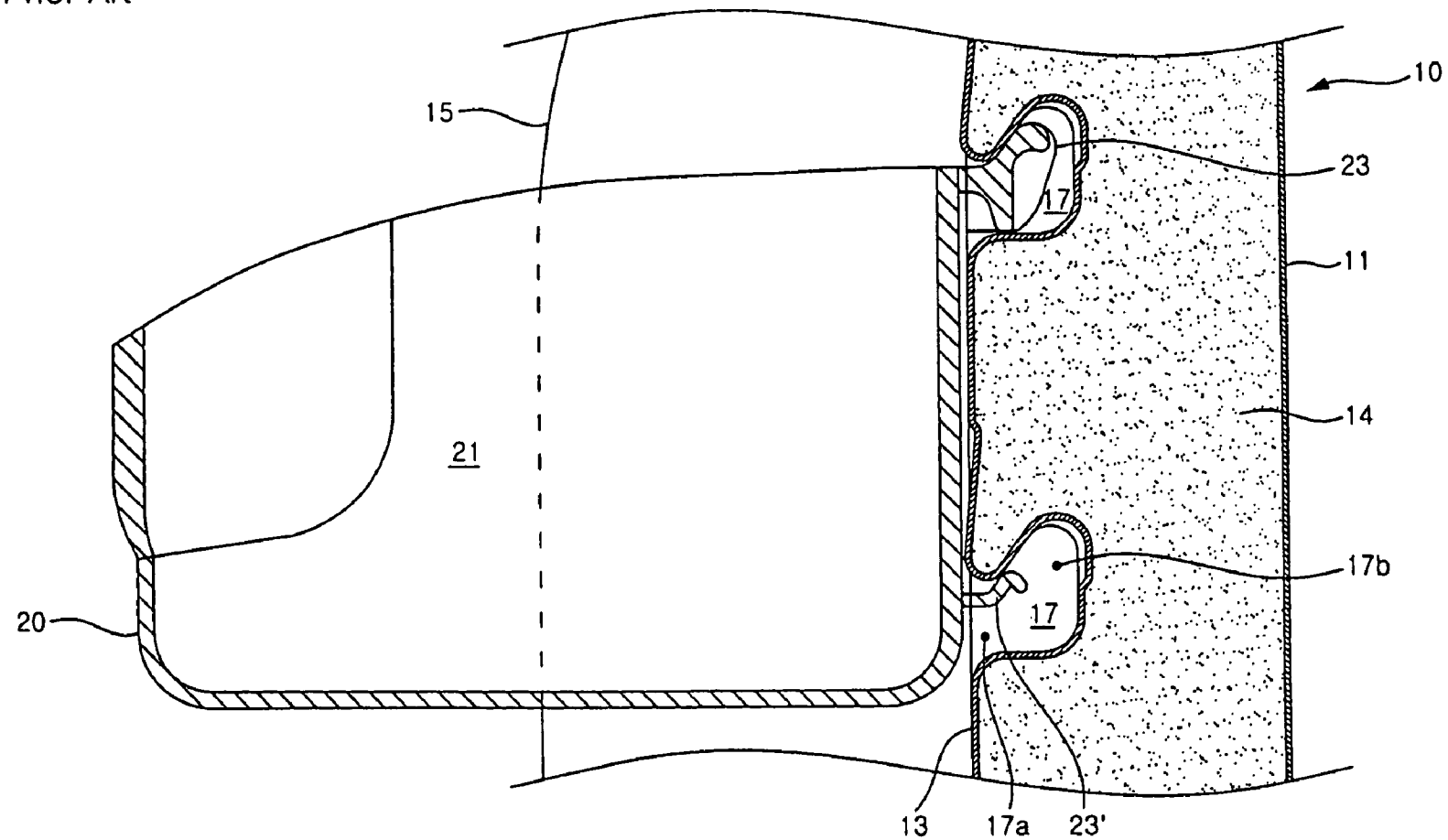
FIG. 1b Prior Art
FIG. 1*b* is a sectional side view of the mounting structure of the door basket shown in FIG. 1*a;*
Figure 2:
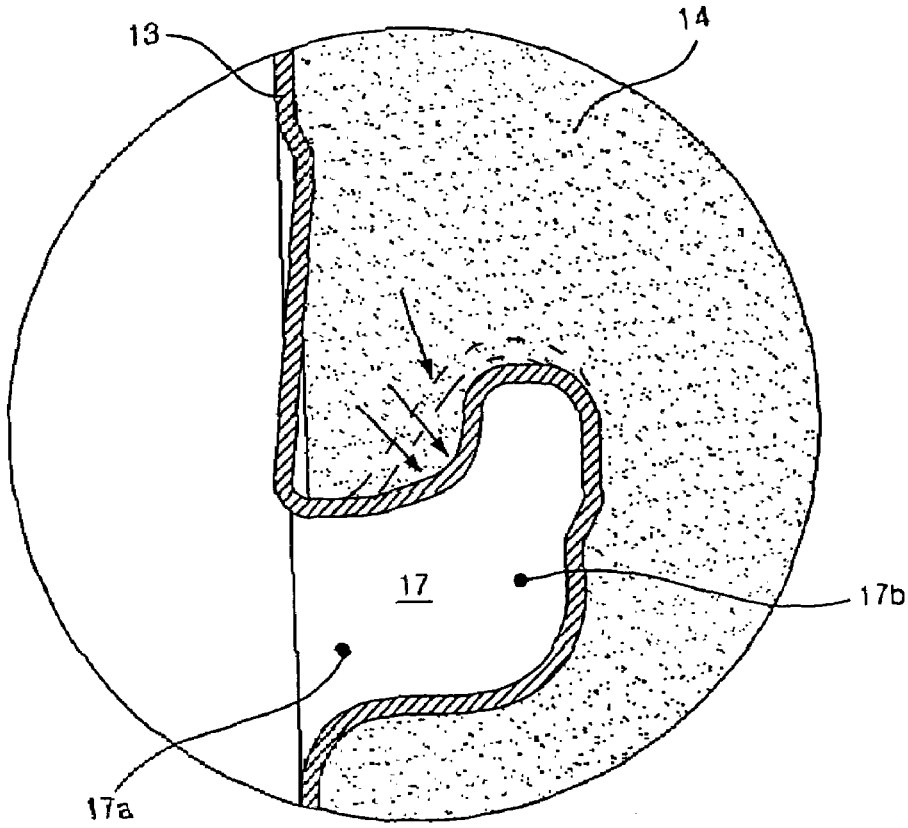
FIG. 2 Prior Art
FIG. 2 is a view illustrating a problem of the mounting structure of the door basket according to the prior art.
Figure 3:
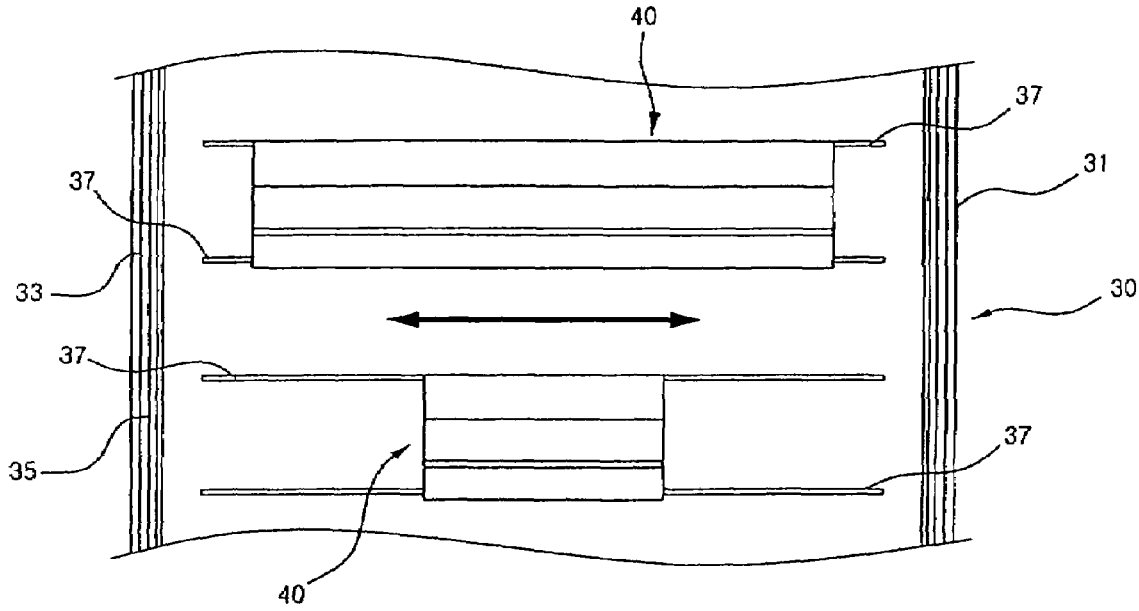
FIG. 3 is a front view showing a preferred embodiment of a mounting structure of a door basket for a refrigerator according to the present invention.
Figure 4:
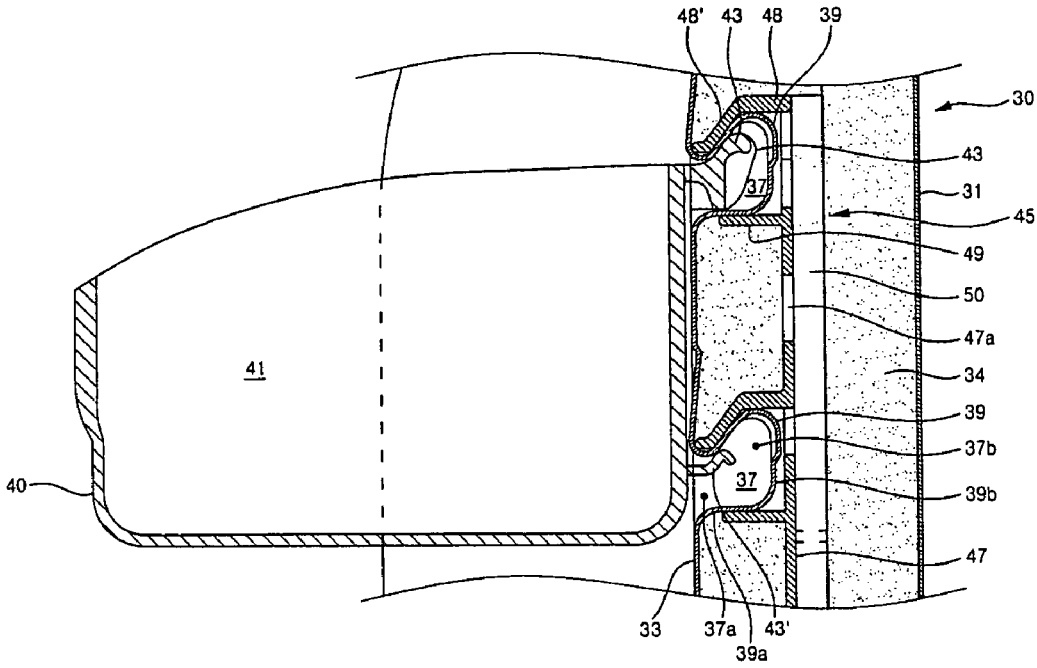
FIG. 4 is a sectional view showing the embodiment of the present invention.
Figure 5:
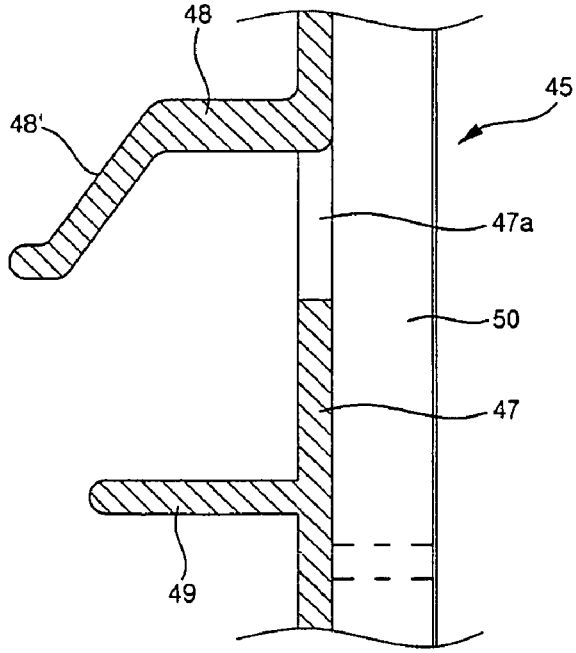
FIG. 5 is a sectional view of a slot cover of the embodiment of the present invention.

FIG. 3 is a front view showing the preferred embodiment of the mounting structure of the door basket for the refrigerator according to the present invention. FIG. 4 is a sectional view showing the embodiment of the present invention. FIG. 5 is a sectional view of a slot cover of the embodiment of the present invention.

As shown in the figures, an external appearance plate 31 defines external appearances of front, side, and upper surfaces of a door 30 of the refrigerator. A door liner 33, which defines an external appearance of a rear surface of the door 30, is engaged to a rear portion of the external appearance plate 31. A space formed between the external appearance plate 31 and the door liner 33 is formed with an insulating layer 34. The insulating layer 34 is formed by filling the space with foam liquid of polyurethane or the like and by solidifying the foam liquid, causing heat exchange between the interior and exterior of the door 30 to be prevented.

Both side ends of an outer surface of the door liner 33 corresponding to the rear surface of the door 30, are formed with a pair of projections 35, which are formed to protrude forward and elongated vertically. A plurality of slots 37 for mounting a door basket 40 are formed from side to side in the outer surface of the door liner 33 between the projections 35.

The slots 37 for mounting the door basket 40 are formed by recessing portions of the door liner 33. In the present embodiment, both opposite ends of each slot 37 need not extend up to the projections 35. It is the reason why mounting projections 43 and 43' formed on a rear surface of the door basket 40 are not formed at both opposite ends of the door basket 40. The mounting projections 43 and 43' may be formed at both opposite ends of the rear surface of the door basket 40. Accordingly, the slots 37 should also extend up to positions adjacent to the projections 35.

The slots 37 include a pair of upper and lower slots in two rows. However, it is not necessary that the pair of the slots 37 should be formed for one of the door baskets 40. Only one of the slots 37 may be formed for one of the door baskets 40. In such a case, preferably, there should be provided a structure for preventing the door basket 40 from floating on the door liner 33 inadvertently.

An inlet 37*a* of the slot 37 is formed to be relatively narrower than an interior 37*b* of the slot 37. In the illustrated embodiment, upon review of a cross section of the slot 37, an upper inner surface thereof inclines upward and inward while an lower inner surface thereof is formed in a substantially horizontal plane. Therefore, the inlet 37*a* is formed to be narrower than the interior 37*b*. However, the lower inner surface of the slot 37 may be formed to incline downward, while the upper inner surface is formed in a substantially horizontal plane. Alternatively, the upper and lower inner surfaces of the slot 37 may be formed to incline upward and downward, respectively.

Here, the slots 37 are formed on the door liner 33, and thus, outward projections 39 of the slots are formed on an inner surface of the door liner 33. The outward projections 39 of the slots protrude rearward from the rear surface of the door liner 33 corresponding to the slots 37. Therefore, proximal portions 39*a* of the outward projections 39 correspond to the inlets 37*a* of the slots 37, and distal portions 39*b* of the outward projections 39 are formed to be relatively wider than the proximal portions 39*a*, respectively.

In the meantime, a storage space 41 is formed from side to side within the door basket 40 mounted onto the door liner 33. However, the door basket 40 is formed to be shorter than an interval between the projections 35. The rear surface of the door basket 40 is formed with the plurality of the mounting projections 43 and 43' for mounting the door basket 40 onto the door liner 33.

A pair of mounting projections 43 and 43', which protrude rearward, are provided at upper and lower portions on the rear surface of the door basket 40 in two rows. The pairs of mounting projections 43 and 43' may be formed from side to side at the upper and lower portions of the rear surface of the door basket 40, respectively. Alternatively, a plurality of the mounting projections may be discretely formed on each of the upper and lower portions. Preferably, two of the mounting projections 43 are formed at both ends of the relatively upper portion of the rear surface of the door basket 40, while one of the mounting projections 43' is formed at the relatively lower portion of the rear surface of the door basket 40.

The upper mounting projection 43 extends to incline rearward and upward to correspond to an internal shape of the slot 37, and thus, is not inadvertently detached from the slot 37 (i.e., by allowing the upper mounting projection to be press fitted into the inlet 37*a* of the slot 37). Although the lower mounting projection 43' is sized to freely come in and out the slot 37, the mounting projection 43' is caught onto (brought into contact with) a ceiling of the slot 37, and thus, serves to support load of the door basket 40. (The mounting projection 43' is formed relatively smaller than the inlet of the slot 37.) The door basket 40 including the mounting projection 43 or the mounting projections 43 and 43' may be formed of material having predetermined elasticity.

In addition, a slot cover 45 is installed on the inner surface of the door liner 33. The slot cover 45 prevents the shape of the slots 37 from being deformed by a pressure of the foam liquid in a foaming process. The slot cover 45 prevents the pressure of the foam liquid from being transmitted to the outward projections 39.

The slot cover 45 comprises a cover body 47 spaced apart by a predetermined interval from the inner surface of the door liner 33 and upper and lower cover portions 48 and 49 protruding from a surface of the cover body 47 in order to protect upper and lower portions of the outward projections.

The cover body 47 is formed with a size corresponding to a region including the whole of the slots 37 of the door liner 33. The cover body 47 is provided adjacent to the distal portions 39*b* of the outward projections 39. It is preferred that a distance where the cover body 47 is spaced apart from the door liner 33 be larger than a protruding length of the outward projections 39, i.e., a recessed length of the slots 37.

In the meantime, the upper and lower cover portions 48 and 49 protrude forward from the surface of the cover body 47 at positions corresponding to the upper and lower surfaces of the outward projection 39. The respective upper and lower cover portions 48 and 49 are formed to be in close contact with the upper and lower surfaces of the outward projections 39, respectively. Therefore, in the present embodiment, a distal end of the upper cover portion 48 is provided with an inclined portion 48'.

In the state that the upper and lower surfaces of the outward projections 39 are adjacent to the upper and lower cover portions 48 and 49, i.e., the outward projections 39 are positioned between the upper and lower cover portions 48 and 49, the inclined portion 48' functions to temporarily fix the slot cover 45 in order not to be detached. The inclined portion 48' extends to incline downward from the distal end of the upper cover portion 48 to the proximal portion 39*a* of the outward projection 39. The number of the upper and lower cover portions 48 and 49 is determined so as to correspond to the number of the outward projections 39, i.e. the slots 37.

In the illustrated embodiment, since an inner upper surface of the slot 37, i.e., the upper surface of the outward projection 39 is formed to incline, the inclined portion 48' is provided at the distal end of the upper cover portion 48. However, if an inner lower surface of the slot 37, i.e., the lower surface of the outward projection 39 is formed to incline, the inclined portion 48' may be provided at a distal end of the lower cover portion 49.

In addition, the cover body 47 is formed with a plurality of holes 47*a*. The holes 47*a* are formed by perforating portions of the cover body 47. The holes 47*a* serve to allow the foam liquid filled between the external appearance plate 31 and the door liner 33 to flow into a space between the door liner 33 and the slot cover 45.

The cover body 47 is formed with at least one reinforcement rib 50 opposite to the surface formed with the upper and lower cover portions 48 and 49. Even though the reinforcement rib 50 is not necessarily provided, it is formed in order to keep strength of the slot cover 45 at above a certain value.

Hereinafter, the operation of the mounting structure of the door basket for the refrigerator according to the present invention configured as above will be described in detail.

In order to manufacture the door 30, the space in which the insulating layer 34 will be formed is provided by combining the external appearance plate 31 and the door liner 33. The door liner 33 is naturally mounted with the slot cover 45.

The slot cover 45 is installed by catching the upper and lower cover portions 48 and 49 onto the outward projections 39 formed on the inner surface of the door liner 33. That is, the slot cover 45 is positioned on the inner surface of the door liner 33. Here, portions between the upper and lower cover portions 48 and 49, more concretely, between distal ends of the inclined portions 48' and the distal ends of the lower cover portions 49 are in positions corresponding to the distal portions 39*b* of the outward projections 39, respectively.

In such a state, the slot cover 45 is pushed toward the inner surface of the door liner 33 so that each of the outward projections 39 is inserted between the inclined portion 48' and the lower cover portion 49. Accordingly, the respective outward projections 39 of the door liner 33 are inserted between the upper and lower cover portions 48 and 49 of the slot cover 45, and thus, the slot cover 45 is temporarily fixed.

That is, while the upper surface of the outward projection 39 is in close contact with a lower surface of the upper cover portion 48, the lower surface of the outward projection 39 is in close contact with an upper surface of the lower cover portion 49. In addition, the inclined portion at the upper surface of the outward projection 39 is in close contact with a lower surface of the inclined portion 48' which inclines downward from the upper cover portion 48.

Then, in order to form the insulating layer 34 in the space between the external appearance plate 31 and the door liner 33 with the slot cover 45 mounted as above, the space is filled with the foam liquid. Here, since the slot cover 45 is temporarily fixed, the slot cover 45 does not move from its installed position in the foaming process, and then, is completely fixed if the foam liquid is solidified.

During the foaming process, the foam liquid can also flow into the space between the door liner 33 and the slot cover 45 through the foamed holes 47*a* formed in the cover body 47. Further, since the upper and lower cover portions 48 and 49 of the slot cover 45 envelops the outward projection 39, it is possible to prevent the outward projections 39, i.e. the slots 37, from being deformed due to the pressure of foam liquid to be filled therein.

If the insulating layer 34 is completed by solidifying the foam liquid, the door 30 is also completed. The completed door 30 is mounted with a variety of parts such as the door basket 40. That is, the door basket 40 is mounted onto the door liner 33 as the mounting projections 43 and 43' provided on the rear surface of the door basket 40 are inserted into the slots 37. Here, if the mounting projection 43 is pushed and inserted into the slot 37 from front to rear thereof, while the mounting projection 43 and the inlet 37*a* of the slot 37 are somewhat elastically deformed, the mounting projection 43 is inserted into the slot 37. Then, the mounting projection 43' is caught onto the ceiling of the lower slot of the pair of the slots 37.

If the mounting projections 43 and 43' are inserted into the slots 37 as above, it is possible for the door basket 40 to move from side to side. Therefore, a user may use the plurality of the door baskets 40 provided on the outer surface of the door liner 33 with installation positions of the door baskets 40 being set.

According to the mounting structure of the door basket for the refrigerator according to the present invention as described above, the following advantages can be expected.

The present invention employs the slot cover for preventing the shape of the slots formed on the door liner from being deformed during the manufacturing process of the door. Therefore, there is an advantage in that the slots are prevented from being deformed in the forming process of the insulating layer, causing the defectiveness of the article to be removed.

In addition, according to the present invention, since the slot cover prevents the slots formed on the door liner from being deformed, the thickness of the door liner can be set up to a minimum design value. Therefore, the production costs of the door may be reduced.

The scope of the present invention is not limited to the embodiment described and illustrated above but is defined by the appended claims. It will be apparent that those skilled in the art can make various modifications thereto within the scope of the fundamental technical spirit of the present invention. Therefore, the true scope of the present invention should be defined by the appended claims.

What is claimed is:

1. A door basket mounting structure for a refrigerator, comprising:

a door liner that defines a rear surface of a door, the door liner including at least one slot, the at least one slot being formed to extend from side to side by recessing a portion of an outer surface of the door liner;

a slot cover configured to protect at least one outward projection of the at least one slot from a foam pressure applied when forming an insulating layer, the outward projection of the at least one slot being formed on a rear surface of the door liner by forming the at least one slot; and a door basket formed with a storage space therein and provided with at least one mounting projection configured to be inserted into and slid from side to side along the at least one slot, wherein the slot cover comprises:

a cover body installed in a position spaced apart by a predetermined interval from an inner surface of the door liner, the cover body being adjacent to a distal portion of the mounting projection; and at least one pair of upper and lower cover portions protruding from a surface of the cover body toward the at least one mounting projection, the upper and lower cover portions being shaped to correspond to upper and lower surfaces of the at least one mounting projection, respectively.

2. The mounting structure as claimed in claim 1, wherein an inlet of the at least one slot is formed to be relatively narrower than an interior thereof, and a distal end of the at least one pair of upper and lower cover portions further comprises an inclined portion, the inclined portion extending to incline at a predetermined angle toward a proximal portion of the mounting projection corresponding to the inlet of the at least one slot and being in close contact with the mounting projection.

3. The mounting structure as claimed in claim 1, wherein the mounting projection is inserted between the upper and lower cover portions, so that the slot cover is temporarily fixed to the inner surface of the door liner.

4. The mounting structure as claimed in claim 1, wherein the slot cover is further provided with a plurality of holes configured to receive foam liquid injected therethrough to insulate an interior of the door, the foam liquid flowing through the holes into a space between the door liner and the slot cover.

5. The mounting structure as claimed in claim 1, wherein the slot cover further comprises a reinforcement rib opposite to a surface formed with the upper and lower cover portions.

6. A refrigerator comprising the mounting structure of claim 1.

7. A door basket mounting structure for a refrigerator, comprising:

a door liner that defines a rear surface of a door, the door liner including at least one slot;

a slot cover configured to protect at least one outward projection of the at least one slot from foam pressure applied when forming an insulating layer; and a door basket provided with at least one mounting projection configured to be inserted into and slid in a longitudinal direction along the at least one slot, wherein the slot cover comprises:

a cover body installed in a position spaced apart by a predetermined interval from an inner surface of the door liner, the cover body being adjacent to a distal portion of the mounting projection; and at least one pair of upper and lower cover portions protruding from a surface of the cover body toward the at least one mounting projection, the at least one pair of upper and lower cover portions being shaped to correspond to upper and lower surfaces of the at least one mounting projection, respectively.

8. The mounting structure as claimed in claim 7, wherein an inlet of the at least one slot is formed to be relatively narrower than an interior thereof, and a distal end of the at least one pair of upper and lower cover portions further comprises an inclined portion, the inclined portion extending to incline at a predetermined angle toward a proximal portion of the mounting projection corresponding to the inlet of the at least one slot and being in close contact with the mounting projection.

9. The mounting structure as claimed in claim 7, wherein the mounting projection is inserted between the at least one pair of upper and lower cover portions, so that the slot cover is temporarily fixed to the inner surface of the door liner.

10. The mounting structure as claimed in claim 7, wherein the slot cover is further provided with a plurality of holes configured to receive foam liquid injected therethrough to insulate an interior of the door, the foam liquid flowing through the holes into a space between the door liner and the slot cover.

11. The mounting structure as claimed in claim 7, wherein the slot cover further comprises a reinforcement rib opposite to a surface formed with the at least one pair of upper and lower cover portions.

12. A refrigerator comprising the mounting structure of claim 7.

13. A door basket mounting structure for a refrigerator, comprising:

a door liner that defines a rear surface of a door, the door liner including at least one slot, the at least one slot being formed to extend from side to side by recessing a portion of an outer surface of the door liner;

a slot cover configured to protect at least one outward projection of the at least one slot from a foam pressure applied when forming an insulating layer, the outward projection of the at least one slot being formed on a rear surface of the door liner by forming the at least one slot, wherein the slot cover is installed on the inner surface of the door liner; and a door basket formed with a storage space therein and provided with at least one mounting projection configured to be inserted into and slid from side to side along the at least one slot, wherein the slot cover is further provided with a plurality of holes configured to receive foam liquid injected therethrough to insulate an interior of the door, the foam liquid flowing through the holes into a space between the door liner and the slot cover.

14. The mounting structure as claimed in claim 13, wherein the slot cover comprises:

a cover body installed in a position spaced apart by a predetermined interval from an inner surface of the door liner, the cover body being adjacent to a distal portion of the mounting projection; and at least one pair of upper and lower cover portions protruding from a surface of the cover body toward the at least one mounting projection, the upper and lower cover portions being shaped to correspond to upper and lower surfaces of the at least one mounting projection, respectively.

15. The mounting structure as claimed in claim 14, wherein an inlet of the at least one slot is formed to be relatively narrower than an interior thereof, and a distal end of the at least one pair of upper and lower cover portions further comprises an inclined portion, the inclined portion extending to incline at a predetermined angle toward a proximal portion of the mounting projection corresponding to the inlet of the at least one slot and being in close contact with the mounting projection.

16. The mounting structure as claimed in claim 14, wherein the mounting projection is inserted between the upper and lower cover portions, so that the slot cover is temporarily fixed to the inner surface of the door liner.

17. The mounting structure as claimed in claim 14, wherein the slot cover further comprises a reinforcement rib opposite to a surface formed with the upper and lower cover portions.

18. A refrigerator comprising the mounting structure of claim 13.

* * * * *